US006224964B1

(12) United States Patent
Kawai et al.

(10) Patent No.: US 6,224,964 B1
(45) Date of Patent: May 1, 2001

(54) THERMAL TRANSFER SHEET, IMAGE-PRINTED MATERIAL AND RECORDING METHOD

(75) Inventors: Satoru Kawai; Masayasu Yamazaki; Kenichiro Suto; Katsuyuki Oshima, all of Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/459,030

(22) Filed: Dec. 10, 1999

Related U.S. Application Data

(62) Division of application No. 09/282,084, filed on Mar. 30, 1999, now Pat. No. 6,071,596, which is a division of application No. 08/772,389, filed on Dec. 23, 1996, now Pat. No. 5,977,022.

(30) Foreign Application Priority Data

Dec. 26, 1995 (JP) ..... 7-351420

(51) Int. Cl.[7] ..... B41M 5/26

(52) U.S. Cl. ..... 428/195; 428/207; 428/348; 428/349; 428/354; 428/913; 428/914

(58) Field of Search ..... 428/195, 207, 428/343, 346–349, 354, 913, 914

(56) References Cited

U.S. PATENT DOCUMENTS 5,525,403 * 6/1996 Kawabata et al. ..... 428/212

FOREIGN PATENT DOCUMENTS 7-77832 * 3/1995 (JP) .

* cited by examiner

*Primary Examiner*—Bruce H. Hess
(74) *Attorney, Agent, or Firm*—Ladas & Parry

(57) ABSTRACT

Provided is two kind of thermal transfer sheets comprising a substrate and a white transfer layer, the white transfer layer being to be transferred onto an image-formed portion of an image-receiving sheet. In the one kind, white transfer layer includes a white ink layer containing a white pigment and/or a filler, and has a total light transmittance of 30 to 95% and a haze of 30 to 95% due to the white ink layer. In another kind, the white transfer layer includes a white ink layer and a peeling layer, the white ink layer containing a white pigment and/or a filler, the peeling layer laminated between the white ink layer and the substrate, and capable of causing a cohesive failure thereby converting into an irregular surface of a printed material through a transferring process. The present invention also provides printed materials by the using of the thermal transfer sheets described above and recording methods for producing of the printed materials. The printed material can be used as an electric-decorating display member.

12 Claims, 4 Drawing Sheets

THERMAL TRANSFER SHEET, IMAGE-PRINTED MATERIAL AND RECORDING METHOD

This application is a division of U.S. Ser. No. 09/282,084, now U.S. Pat. No. 6,071,596 filed Mar. 30, 1999, which is a division of U.S. Ser. No. 08/772,389, now U.S. Pat. No. 5,977,022 filed Dec. 23, 1996, which U.S. applications are all hereby incorporated herein by reference.

BACKGROUND OF THE INVENTION

The present invention is achieved through the formation of images by employing a thermal transfer method such as sublimable thermal transfer method or the like. More particularly, the present invention relates to an image-printed material used as an electric-decorating display members as well as a thermal transfer sheet and a recording method used in producing the image-printed material.

Conventional electric-decorating display members are made, for example, by printing characters and images on films, such as plastic films through a method of offset printing or gravure printing with the use of a previously prepared form plate. When a clear film is used, white ink is solid-printed over a printed portion of the clear film, to form an electric-decorating display member. In these methods, characters and/or images formed on substrates should has the identical information for one printing lot.

In contrast, as can be seen in recent personal use, there has been strong needs that different characters and/or images can be printed at every time so as to vary the information on every electric-decorating display member. To meet such needs, the electric-decorating display member is formed by that, for the purpose of increasing absorption of water-color ink, a receptor layer containing fillers and high-absorbing resins is provided on a substrate made of hydrophobic substances such as plastic films, then the characters and/or images are recorded on the receptor layer through ink jet printing. Thus recorded characters and/or images constitute variable information (different pieces information) and satisfy the above-mentioned demand.

When looking at an electric-decorating display members, it is required to install an electric-decorating apparatus having a light diffusion layer capable of not only irradiating light onto the members but also performing appropriate light diffusion. In addition, a light diffusion layer may be added to the illuminating display member to enhance attractiveness of images formed on the layer in cooperation with appropriate light transmission assigned to the layer.

Further, various methods of providing the above-mentioned different pieces information, except the ink-jet method, have also been known. Among them, a method called "sublimable thermal transfer method" has occupied the attention. The method, which uses sublimable dyes, produces full color images having excellent continuous gradations and being almost equal to color photographs.

A thermal transfer sheet for the sublimable thermal transfer method is generally provided with a such substrate as a polyester film. On one side surface of the substrate, a dye layer containing of sublimable dyes and a binder are formed, while on its other side surface, a heat-resisting layer is formed for preventing adhesion with the thermal head.

The thermal transfer sheet is put on an image-receiving sheet having a receptor layer, such as a polyester resin, in a manner that the dye surface of the thermal transfer sheet faces the receptor layer. Applying heat to the side of the heat-resisting layer of the thermal transfer sheet by the thermal head according to the shapes of images causes dye in the dye layer to transfer into the receptor layer of the image-receiving sheet, thus forming desired images on the image-receiving sheet.

Based on such sublimable thermal transfer method, Japanese Patent No. 7-77832 discloses one example of the thermal transfer sheets. This exemplified a thermal transfer sheet which having a substrate on which provided are an image-receiving transfer resin layer having dye receptive performance, a thermal transfer layer containing dyes, and a hiding white-color transfer layer for hiding images transferred with the thermal transfer layer. This thermal transfer sheet makes it possible to transfer the image-receiving transfer resin layer on a transparent supporting member, to form transfer images with the thermal transfer layer on the thus transferred image-receiving transfer resin layer, and to additionally transfer the hiding white transfer layer on the images. This provides image-printed materials.

In thus-provided image-printed materials, however, the role of the white transfer layer is to reflect light entering through the transparent supporting member and to raise the density of the transferred images when looked laterally through the transparent supporting member. In other words, the images are produced as being reflection images which do not have appropriate light transmission property and light diffusion property, both of which are necessarily required to electric-decorating display members.

As summaries, there are following drawbacks in the conventionally used electric-decorating display members. When such display members are produced by an offset printing method etc. with the use of pre-formed plates, characters and/or images having only a single piece of information are provided in each printing lot. Hence, there is a drawback that such printing methods cannot satisfy users who desires to have electric-decorating display members on which characters and/or images having different pieces of information are formed in each printing lot, as is required in personal use.

In order to meet such diversification in printed information, there is known an ink jet method. However, this ink jet method also has some drawbacks. That is, water-soluble ink is used for forming images, with the result that image-printed materials are poor in durability including water resistance and scuff resistance, and gradation of images is also poorer than color photographs.

An object of the present invention is to solve the above-mentioned various problems, and to provide image-printed materials handled as electric-decorating display members (i); on which different pieces of information made up of characters and/or images can easily be formed member by member, as is required in personal use, (ii); which have higher durability including water resistance and scuff resistance, (iii); which have an image quality providing a continuous gradation as excellent as in color photographs, and (iv); which look attractively by virtue of appropriate light diffusion and transmission properties, to provide thermal transfer sheets used in producing the image-printed materials, and to provide a recording method of obtaining the image-printed materials.

SUMMARY OF THE INVENTION

In order to accomplish the foregoing objects, as the first invention, in accordance with the invention, there is provided a thermal sheet comprising a white transfer layer and a substrate, the white transfer layer transferable to an image-receiving sheet is provided on at least one region of the substrate, wherein the white transfer layer has a single layer construction of a white ink layer or a multi-layer construction including at least the white ink layer, the white ink layer contains at least one component selected from a group of components consisting of a white pigment and a filler, and the white transfer layer has a total light transmittance of 30 to 95% and a haze of 30 to 95%.

As the second invention in accordance with the invention, there is provided a thermal transfer sheet comprising a white transfer layer and substrate, the white transfer layer transferable to an image-receiving sheet is provided on at least one region of the substrate, wherein the white transfer layer has a multi-layer construction including at least a peeling layer and a white ink layer, the peeling layer being positioned in contact with the substrate, the white ink layer contains at least one component selected from a group of components consisting of a white pigment and a filler, and the peeling layer, in thermal transfer processing, capable of not only being torn at a center or approximate center in a range of thickness of the peeling layer but also causing a cohesive failure on a torn surface of the peeling layer so that irregularities are formed on the torn surface owing to the cohesive failure.

Each of the thermal transfer sheets according to the first and second invention may be formed into either a separation-type comprising only the white transfer layer on the substrate or a monolithic-type comprising the white transfer layer and dye layer sequentially and alternately on the same surface of the substrate. As to the former type, the thermal transfer sheet must be used in combination with another thermal transfer sheet comprising only the dye layer on the substrate. As to the latter type, such combination is unnecessary.

As the third invention in accordance with the invention, there is provided an image-printed material manufactured by performing thermal transfer processing to image-receiving sheet, wherein the material comprising at least an image-formed portion formed by migrating a dye from a dye layer of a thermal transfer sheet to a substrate or an image-receiving layer of the image-receiving sheet and a white layer having a single layer construction of a white ink layer or a multi-layer construction including at least the white ink layer and being provided on the image-formed portion, wherein the white ink layer contains at least one component selected from a group of components consisting of a white pigment and a filler, and the white layer has a total light transmittance of 30 to 95% and has a haze of 30 to 95%.

As the fourth invention in accordance with the invention, there is provided an image-printed material manufactured by performing thermal transfer processing to an image-receiving sheet, wherein the material comprising at least an image-formed portion formed by migrating a dye from a dye layer of a thermal transfer sheet to a substrate or an image-receiving layer of the image-receiving sheet and a white layer having a multi-layer construction including at least a peeling layer and a white ink layer and being provided on the image-formed portion, wherein the white ink layer contains at least one component selected from a group of components consisting of a white pigment and a filler, and a surface of the peeling layer is provided with irregularities on the surface.

The image-printed materials according to the third and fourth invention are manufactured, for example, by the following method. The thermal transfer, sheet according to the first or second invention and an image-receiving sheet to be converted into an image-printed material are prepared. Still, if necessary, another thermal transfer sheet comprising the dye layer is prepared. Then heat is applied so as to make dyes migrate from the dye layer of the thermal transfer sheet in accordance with the invention or another thermal transfer sheet to the substrate or image-receiving layer of the image-receiving sheet, thereby forming images thereon. The white transfer layer is then transferred from the thermal transfer sheet onto the image-formed surface of the image-receiving sheet, thereby forming a white layer thereon. As a result, the image-printed material of the invention is provided.

Performing thermal transfer with the thermal transfer sheet according to the first invention permits the white layer to be transferred onto the image-formed portion of an image-printed material, the white layer having a total light transmittance of 30 to 95% and a haze of 30 to 95%. Hence, there is provided the image-printed material suitably possessing both light diffusion and light transmission, which are needed to an electric-decorating display member. Likewise, the thermal transfer sheet can be used for recording characters and images based on sublimable thermal transfer. This means that the thermal transfer sheet is capable of meeting the demand that different pieces of information of characters and images are wanted to be recorded, as seen in personal use. Additionally, the thermal transfer sheet is able to provide image-printed materials with not only higher durability associated with water-proof performance and scuff resistance but also image quality with excellent continuous gradations comparable to color photographs.

The image-printed material according to the third invention can be formed through thermal transfer using the thermal transfer sheet according to the first invention. Accordingly, as understood from the above, because of comprising the white layer being placed on the image-formed portion and having a predetermined range of values of total light transmittance and haze, the image-printed material has suitable light diffusion and light transmission together, which are required to electric-decorating display members. When being formed through sublimable thermal transfer, the image-printed material has suitable light diffusion and light transmission, detailed support for personal needs, excellent durability and continuous gradations, etc. at the same time, thus being fit for personal use, good appearance, and usable as electric-decorating display members holding higher durability.

On the other hand, the image-printed material according to the fourth invention can be produced through thermal transfer using the thermal transfer sheet of the second invention. In the thermal transfer process using the thermal transfer sheet of the second invention, the peeling layer will peel off from the substrate of the thermal transfer sheet by causing, what is called, cohesive failure. The cohesive failure means that when the peeling layer is transferred, it peels off from the substrate of the thermal transfer sheet with horizontal-direction tearing at the central position or thereabout in the direction of its thickness. The exposed surface of the peeling layer positioned at the surface side of the provided image-printed material is, therefore, given irregularities and lacks smoothness.

The irregular surface of the peeling layer has a function of providing the electric-decorating display member good appearance. The image-printed material produced through the above process has a construction wherein the white ink layer is laminated directly or indirectly (e.g. via such intermediate layer as the adhesive layer) on the image-formed surface of the image-receiving layer; the peeling layer is formed directly or indirectly (e.g. via such intermediate layer as the protective layer) on the white ink layer, and another layer is laminated on the peeling layer, if necessary.

The white ink layer included in the above image-printed material contains at least one component selected from a group of components consisting of the white pigment and filler, which makes it suitably transmitted as well as suitably diffused light radiated onto the back of the image-printed material from an electric-decorating light source, resulting in improvement in appearance as the electric-decorating display. However, light transmission of the white ink layer is raised for the purpose of increasing brightness of display, light diffusion of the white ink layer is lowered to deteriorate uniformity of display. In contrast, light diffusion of the white ink layer is raised for the purpose of increasing uniformity of display, light transmission of the white ink layer is lowered to darken display. Namely, it is difficult to have enough satisfied characteristics of both the light diffusion and light transmission by controlling only the white ink layer of an image-printed material.

To solve this problem, the foregoing irregular surface of the peeling layer is effective. In other words, in the case of the image-printed material according to the invention, the cohesive failure caused in the peeling layer in the transfer processing allows the exposed surface of the peeling layer to produce irregularities thereon. This irregular surface diffuses and reflects light sent from an electric-decorating light source. This results in that the peeling layer having the irregular surface can help to raise the light diffusion of the white ink layer and provide image-printed materials excellence in both the light transmission and light diffusion. Accordingly, image-printed materials of the fourth invention can be used as electric-decorating display members having not only excellent light transmission but also excellent light diffusion, and nicer in appearance.

Likewise, in cases where image-printed materials of the fourth invention are produced through sublimable thermal transfer, they have suitable light diffusion and light transmission, detailed support for personal needs, excellent durability and continuous gradations, etc. at the same time, thus being fit for personal use, good appearance, and usable as electric-decorating display members holding higher durability.

DESCRIPTION OF THE PREFERRED EMBODIMENTS

Referring now to the accompanying drawings by way examples, the preferred embodiments of the invention are described in detail.

Figure 1:
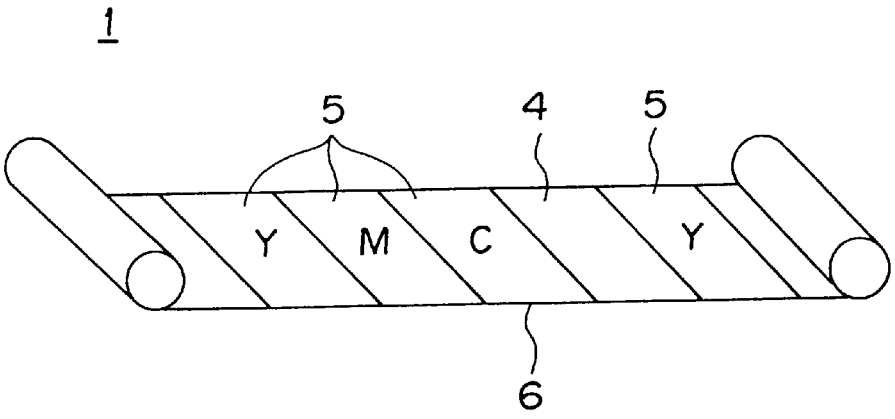
FIG. 1 is a schematic perspective view showing one example of monolithic-type thermal transfer sheets included in the invention.

FIG. 1 shows one example of thermal transfer sheets according to the first invention. In FIG. 1, a thermal transfer sheet 1 is made into a monolithic thermal transfer sheet on which a dye layer 5 of respective hues consisting of yellow (Y), magenta (M), cyan (C) and not-shown black (B) and a white transfer layer 4 are sequentially, alternately, and layer by layer on the same surface of a substrate 6.

Figure 2:
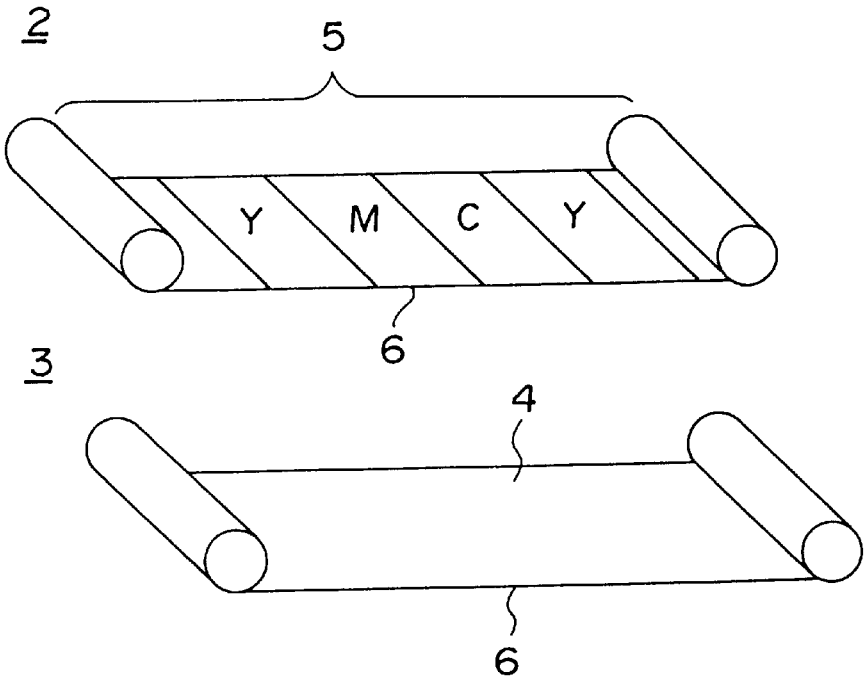
FIG. 2 is a schematic perspective view showing one example of separation-type thermal transfer sheets included in the invention.

Alternatively, another form of a thermal transfer sheet may be used, as shown in FIG. 2, in which two thermal transfer sheets 2 and 3 are adopted such that one sheet 2 comprises a dye layer 5 of respective hues consisting of yellow(Y), magenta (M), cyan(C) and not-shown black (B) all of which are placed sequentially, alternately, and layer by layer on the same surface of a substrate 6, while the other sheet 3 comprises solely a white transfer layer 4 placed on one surface of another substrate 6.

Figure 3:
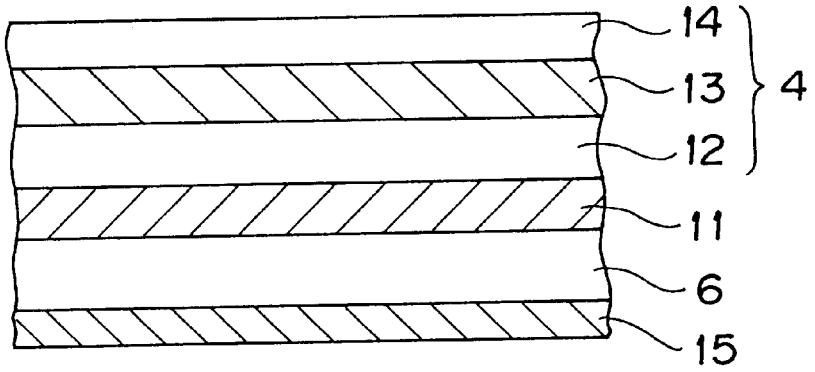
FIG. 3 is a schematic sectional view indicative of one example of white transfer layers according to the first invention.

The white transfer layer 4 is configured as exemplified in FIG. 3. On one surface of the substrate 6, a protective layer 12, white ink layer 13, and adhesive layer 14 are laminated by medium of a release layer 11 in this order when viewing from the substrate 6, although on the other surface, a heat-resisting layer 15 is laminated. In configuring the white transfer layer, however, an absolutely requisite layer is only the white ink layer; the remaining layers can be added only when they are required or can be omitted if unnecessary.

[Substrate]

As applicable thermal transfer sheets of the first invention, there are two types of thermal transfer sheets. One is a monolithic type sheet in which a dye layer and white transfer layer are integrated as shown in FIG. 1, and the other is a separate type sheet in which both the two kinds of layers are separated as shown in FIG. 2. Regardless types of the thermal transfer sheet, the substrate 6 can be used in common, provided that the substrate 6 has as large quantities of heat resistance and strength as in conventionally used ones. Materials available for the substrate includes a wide range of sheet-like members of approximately 0.5 to 50 $\mu$m, preferably 3 to 10 $\mu$m, in thickness, such as not only papers on a variety of converted papers but also a polyester film, polystyrene film, polypropylene film, polysulfone film, aramid film, polycarbonate film, polyvinyl alcohol film, or cellophane, and the like. In particular, a polyester film is more preferable.

When the surface of the substrate has poor adhesiveness with a dye layer formed thereon, it is preferred that such surface is treated with primer processing (adhesion-facilitating processing) or corona discharge processing.

[Dye Layer]

The dye layer 5 can be formed as follows. That is, dyes, binder resins and other arbitrarily-selected ingredients are added into appropriate solvent to dissolve or disperse each ingredient, so that ink for forming the dye layer is prepared. Further, additives such as organic fillers is dispersed into the ink. After this, the ink is coated on the foregoing substrate and consequently dried.

Any kind of dye is usable, not limited to particular one. Dyes which can be used for known thermal transfer sheets are also available for the present invention. Some preferable dyes are; as red dyes, MS Red G, Macrolex Red Vioret R, Ceres Red 7B, Samaron Red HBSL, Resolin Red F3BS, etc.; as yellow dyes, Phorone Brilliant Yellow 6GL, PTY-52, Macrolex Yellow 6G, etc.; and as blue dyes, Kayaset Blue 714, Waxoline Blue AP-FW, Phorone Brilliant Blue S-R, MS Blue 100, etc.

For binder resins to carry and sustain the thermal migratory dyes, any kind of known binder-resin can be used. Among favorable binder resins are; cellulosic resins such as ethyl cellulose, hydroxyethyl cellulose, ethyl hydroxycellulose, hydroxypropyl cellulose, methyl cellulose, cellulose acetate, or cellulose acetate butyrate; vinyl resins such as polyvinyl alcohol, polyvinyl acetate, polyvinyl butyral, polyvinyl acetal, polyvinyl pyrrolidone, or polyacrylamide; or polyester.

As alternative binder resins for carrying and sustaining the thermal migratory dyes, graft copolymer may be adopted to increase releasing performance from image-receiving sheets when image printing is carried out, provided that the graft copolymer contains at least one type of releasing segment selected among a polysiloxane segment, carbon fluoride segment, and long-chain alkyl segment, all of which are graft-coupled with main chains included in an acrylic, vinyl, polyester, polyurethane, polyamide or sellulosic resin.

The organic filler contained in the dye layer may be of any kind, provided that it has high wettability to the ink for forming the dye layer. Exemplified as the organic filler are, known as macromolecule compositions, phenolic resin, melamine resin, urethane resin, epoxy resin, silicone resin, urea resin, diallyl phthalate resin, alkyd resin, acetal resin, acrylic resin, methacrylate resin, polyester resin, cellulosic resin, starch and its derivative, polyvinyl chloride, polyvinylidene chloride, chlorinated polyethylene, fluoro resin, polyethylene, polypropylene, polystyrene, polyvinyl acetal, polyamide, polyvinyl alcohol, polycarbonate, polysulfone, polyethersulfone, polyphenylene oxide, polyphenylene sulfide, polyether etherketone, polyamino bismaleimide, polyarylate, polyethylne terephthalate, polybutylene terephthalate, polyethylene naphthalate, polyimide, polyamide-imide, polyacrylonitrile, AS resin, ABS resin, SBR, and compositions whose main substance is any of the above-exemplified materials.

A typical combination representing excellent wettability between organic fillers and ink for forming the dye layer is provided by polyvinyl acetacetal as a binder resin and polyethylene filler, Fischer-Tropsch wax, and others as an organic filler.

The coating thickness of the dye layer is preferably in a range of 0.2 to 3 $\mu$m in a dry state, more preferably in a range of 0.3 to 2 $\mu$m.

Such dye layer is preferably formed by the following procedures; the foregoing sublimable dyes, binder resin, and other arbitrary ingredients are added together in a given solvent, each ingredient is dissolved or dispersed to prepare the ink for forming the dye layer, the organic filler is dispersed into this ink, which is then coated on the substrate by the method of gravure printing, screen printing, reverse-roll coating using gravure plates, etc. and the ink is dried, with the result that the dye layer is formed.

[Releasing Layer]

The releasing layer 11 can be composed by addition of necessary releasing materials in a binder resin. Usable binder resins are, for example, thermoplastic resins including acrylic resin such as polymethyl methacrylate, polyethyl methacrylate, and butyl methacrylate; vinyl resin such as polyvinyl acetate, polyvinyl chloride-polyvinyl acetate copolymer, polyvinyl alcohol and polyvinyl butyral; cellulose derivative such as ethyl cellulose, nitrocellulose and cellulose acetate; and thermosetting resin including unsaturated polyester; polyester resin; polyurethane resin; and aminoalkyd resin. The releasing layer may contain one or more than one kind of resin exemplified above.

A usable releasing material can be selected among a group of releasing resins including wax, silicone wax, silicone oil, silicone resin, melamine resin and fluoro resin; talc; silica fine particle; or lubricants including surface-active agents and metallic soap.

The releasing layer, as another mode, can also be made of resins having the releasing characteristic. Such usable resins are, for example, silicone resin, melamine resin, fluoro resin, etc. Graft polymer may be used for the releasing layer, the graft polymer composed by graft-coupling a molecule of resin such as acrylic resin, vinyl resin or polyester resin with a releasing segments such as polysiloxane segment or fluorocarbon segment, etc. The releasing layer may contain one or more than one kind of resin exemplified above. In addition, when preparing the releasing layer, known fluorescent brightening agents such as stilbene or pyrazoline may be added into the releasing resin.

The releasing layer can be formed by the same manner as in the foregoing dye layer and its preferable thickness is in a range of 0.1 to 5 $\mu$m after coating and dry processing.

[White Transfer Layer]

The main function of the white transfer layer 4 is to appropriately provide light diffusion and light transmission for an image-printed material i.e., electric-decorating display member to which the white transfer layer is transferred. As shown in FIG. 3, the white transfer layer 4 is normally laminated via the releasing layer 11 on the substrate 6 so as to smoothly be peeled from the substrate. The white transfer layer 4 is provided with the protective layer 12 for enhancing durability such as water resistance and/or scuff resistance, the white ink layer 13 for providing suitable light diffusion and light transmission, the adhesive layer 14 for increasing adhesion between the white transfer layer 4 and an image-receiving sheet when the transfer is performed. The first invention of the present invention necessarily requires that the white transfer layer 4 include at least the white ink layer 13, but in the first invention, it may be possible to suitably remove the remaining layers from the white transfer layer 4. For example, in the case where the white transfer layer 4 is formed after adhesion-facilitating processing on the substrate 6, the releasing layer 11 needs to be interposed between the white transfer layer 4 and the substrate 6, while in the case where a substrate with non-adhesion-facilitating processing is used, the releasing layer 11 can be removed. Alternatively, the releasing, protective, or adhesive layer can be omitted, if the white ink layer 13 or substrate 6 has the functions as any of those three layers.

[Protective Layer]

Figure 4:
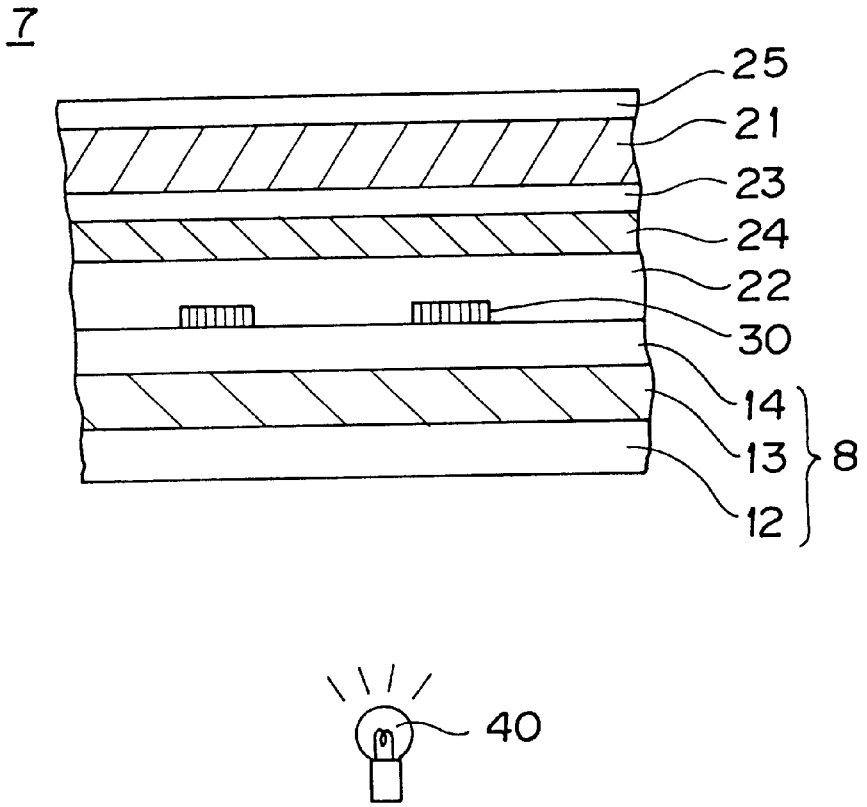
FIG. 4 is a schematic sectional view indicative of one example of image-printed materials according to the third invention.

When the white transfer layer 4 as shown in FIG. 3 is transferred on an image-formed portion of an image-receiving sheet and converted into the white layer 8 as shown in FIG. 4, the protective layer 12 positions at the top surface of an image-printed material and enhances durability including water resistance of images, scuff resistance of images, resistance to fingerprints, resistance to plasticizers and the like.

The protective layer 12 comprises a resin composition composed of at least a binder resin, has a suitable peeling characteristic from the substrate 6 or releasing layer 11, and has desired physical properties fit for the surface-protective layer of a receptor layer 22 after transferring onto an image-receiving sheet. Typical materials which can be used as the protective layer are thermoplastic resins including cellulose derivatives such as ethyl cellulose, nitrocellulose or cellulose acetate; acrylic resin such as polymethyl methacrylate, polyethyl methacrylate, polybutyl acrylate; vinyl polymer such as polyvinyl chloride, vinyl chloride-vinyl acetate copolymer or polyvinyl butyral; and thermosetting resins including polyester resin; polyurethane resin; aminoalkyd resin. If an image-printed material to which the white transfer layer is transferred particularly requires scuff resistance, resistance to chemicals, and stain resistance, ionizing radiation hardenable resins can be used as resins for the protective layer.

In addition, into each of the above-mentioned resin compositions, it is also possible to add lubricants, organic fillers or inorganic fillers for enhancing in scuff resistance of an image-printed material, surface-active agents for stain resistance, ultraviolet absorbers, oxidation inhibitors or fluorescent brightening agents for strengthening weathering performance.

The same forming processing as one used for the above-mentioned dye layer can be applied to the protective layer 12. A preferable thickness of the protective layer is 0.1 to 20 $\mu$m in a coated and dried state.

[White Ink Layer]

The white ink layer 13 included in the white transfer layer 4 has a function to provide properly-determined light diffusion and light transmission for the image-printed material, and it is composed of binder resins and white pigments and/or fillers. Although any binder resin is available, favorable materials are shown such as an acrylic resin, cellulosic resin, polyester resin, vinyl resin, polyurethane resin, polycarbonate resin, or partial crosslinking resins derived from these resins.

As the white pigments and/or fillers which are, for example, hard solid particles of; inorganic fillers such as silica, alumina, clay, talc, calcium carbonate or barium sulfate; white pigments such as titanium oxide or zinc oxide; resin particles (plastic pigment) such as acrylic resin, epoxy resin, urethane resin, phenolic resin, melamine resin, benzoguanamine resin, fluoro resin or silicone resin. Additionally, though there are two types of titanium oxide; rutile titanium oxide and anatase titanium oxide, either type may be employed.

Besides the above-described binder resins and white pigments and/or fillers, fluorescent brightening agents can be added into the white ink layer 13. As to the fluorescent brightening agents, there can be available chemical compounds including stilbenes or pyrazolines for which it is known that it has the fluorescent brightening effect. Yet the white ink layer 13 may contain any type of coloring agents.

Controlling not only the solids content ratio (i.e., P/V ratio) between the white pigment and/or filler and the binder resin but also the thickness of the white ink layer 13 permits the white ink layer 13 to give to an image-printed material proper degrees of light diffusion and light transmission. Such proper light diffusion and light transmission can be brought by controlling the P/V ratio between the white pigment and/or filler and the binder resin into a range of 0.5 to 3.0 or thereabout and controlling the thickness of the white ink layer 13 into a range of 0.5 to 2.0 $\mu$m or thereabout in the dry state. Still it is preferred to control total light transmittance and haze into desired ranges of values.

To be specific, controlling the total light transmittance and haze provided in JIS K7105 into the following ranges leads to an excellent electric-decorating display member of an appropriate haze. The haze is calculated by dividing the diffusing transmittance by the total light transmittance.

In cases where a thermal transfer sheet has the white transfer layer 4 containing a laminated white ink layer 13, there is provided an excellent electric-decorating display member by controlling not only the total light transmittance of the white transfer layer 4 into a range of 30 to 95%, preferably in a range of 50 to 85%, but also the haze into a range of 30 to 95%, preferably in a range of 50 to 90%.

[Adhesive Layer]

It is preferred that the adhesive layer 14 be used in cases where adhesion performance between the white ink layer and a receptor layer of an image-receiving layer is low.

Materials which provide a higher adhesive performance to the receptor layer of the image-receiving layer are used as the adhesive layer 14. Although it is required to select suitable materials in accordance with the kind of a receptor layer, such materials as thermoplastic resins, natural resins, rubber materials, wax materials, and others, can be typically be employed as the adhesive layer. Exemplified materials suitable for the adhesive layer are cellulose derivative such as ethyl cellulose or cellulose acetate butyrate; styrene copolymer such as polystyrene or poly-$\alpha$-methylstyrene; acrylic resin such as polymethyl methacrylate, polyethyl methacrylate, methacrylate, or polyethyl acrylate; vinyl resin such as polyvinyl chloride, polyvinyl acetate, vinyl chloride-vinyl acetate copolymer or polyvinyl butyral; the other synthetic resins such as polyester resin, nylon resin, epoxy resin, urethane resin, ionomer, ethylene-acrylic acid copolymer ethylene-acrylic acid ester; tackifiers such as rosin, rosin modified mareic acid resin, ester gum, polyisobutylene rubber, butyl rubber, styrene-butadiene rubber, butadiene rubber, acrylonitrile rubber, polyamide resin or chlorinated polyolefin. Still the adhesive layer can also be made from compositions containing one or more than one kind of materials selected from the above-exemplified list.

Materials other than those described above may be added into the adhesive layer 14. For example, known fluorescent brightening agents such as stilbenes or pyrazolines may be added into the adhesive layer 14. Alternately, for the purpose of preventing thermal transfer sheet from blocking at the time of storing in a sheet-roll state, the above-mentioned organic fillers for the dye layer or the above-mentioned inorganic fillers such as white pigments and/or fillers for the white ink layer is added into the adhesive layer 14.

The thickness of the adhesive layer 14 is determined so as to show a higher adhesive performance to the receptor layer. Normally, in the dried state, a preferable thickness is in a range of 0.1 to 20 $\mu$m. The adhesive layer 14 is formed by using the same coating and drying method as one described in the above-described dye layer.

[Heat-Resisting Layer]

In the thermal transfer sheet according to the present invention, in order to avoid drawbacks which appears as sticking or printing creases caused by the heat of the thermal head, it is preferred to laminate the heat-resisting layer 15 on the back of the thermal transfer sheet.

Any known heat-resisting resins can be used to form the heat-resisting layer 15. For example, there can be employed a variety of materials including polyvinyl butyral resin, polyvinyl acetacetal resin, polyester resin, vinyl chloride-vinyl acetate copolymer, polyether resin, polybutadiene resin, styrene-butadiene copolymer, acrylic polyol, polyurethane acrylate, polyester acrylate, polyether acrylate, epoxy acrylate, prepolymer of urethane or epoxy, nitrocellulose resin, cellulose nitrate resin, cellulose acetopropionate resin, cellulose acetate-butyrate resin, cellulose acetate hydrodienephthalate resin, cellulose acetate resin, aromatic polyamide resin, polyimide resin, polycarbonate resin, and chlorinated polyolefin resin.

As examples of agents providing sliding loaded into or face-coated on the heat-resisting layer composed by using the above resins, there can be employed materials including phosphate; fluorine graft polymer; and silicone polymer such as silicone oil, graphite powder, silicone graft polymer, acrylicsilicone graft polymer, acrylicsiloxane or arylsiloxane. The heat-resisting layer 15 preferably contains polyol (such as polyalcohol macromoleculer compound), polyisocyanate compound and phosphate compound, more preferably, further contains a filler.

The heat-resisting layer is formed by a manner such that any resin selected from the above-exemplified list, both an agent providing sliding, and a filler are dissolved or dispersed in a suitably-selected solvent to prepare heat-resisting forming ink, and thus-prepared ink is coated on the back of the substrate by an appropriate method, for example, a gravure printing, screen printing or reverse-roll method with gravure plates, and thus-coated substrate is dried.

[Image-Receiving Layer]

The image-receiving layer is a member to be transferred which is used to form images thereon by using the foregoing thermal transfer sheet. Any material can be used as the image-receiving layer, providing that its image-receiving surface presents a dye-receptive characteristic to the foregoing dyes. In the case where a substrate of the image-receiving sheet is composed of materials which do not have the dye-receptive characteristic, like paper, metal, glass, ceramics, or non-dyeable synthetic resin, it may be suggested that a dye receptor layer be formed on at least one surface of the substrate.

As the substrate of the image-receiving sheet which is dyeable itself and does not require to have the dye receptor layer, for example, there can be use substrate composed of fiber, woven cloth, film, sheet, or molded product, which is made from a material including polyolefin resins such as polypropylene; halogenated polymer such as polyvinyl chloride or polyvinylidene; vinyl polymer such as polyvinyl acetate, vinyl chloride-vinyl acetate copolymer or polyacrylic ester; polystylene resin; polyamide resin; copolymer formed between olefin (i.e., ethylene, propylene or the like) and another vinyl monomer; ionomer; cellulosic resin such as cellulose diacetate; polycarbonate and the like.

In particular, a preferable material as the substrate is a sheet or film comprising polyvinyl chloride, the construction of which may be a single layer or multi-laminated layer.

In the present invention, even though non-dyeable materials such as paper, metal, glass, polyester, polyarylate, polyurethane, polyimide, cellulose derivative, polyethylene or acrylic resin are employed as the substrate for the image-receiving sheet, the image-receiving sheet can be obtained by either of the two methods; one method is to coat the solution or dispersion of the foregoing dyeable resins onto a recording surface of the substrate and dry it, thereby forming a dye receptor layer, while the other method is to laminate a resin film made of the dyeable resins on the substrate.

For use of the substrate made from the synthetic resins, it is possible to employ the synthetic resins provided as a transparent sheet, white film produced by the addition of the white pigment or filler into the synthetic resins, or foamed sheet produced by foaming the synthetic resins, regardless of dyeability of those synthetic resins.

Still, even if the foregoing substrate is dyeable, it is also possible to form on its surface the above-described dye receptor layer using more dyeable resins than the substrate.

The dye receptor layer can be made from either a single material or a plurality of materials. Additionally, within the scope of the present invention, a variety of additives can be contained in the dye receptor layer. For example, a releasing agent can be added to prevent a thermal transfer sheet and an image receiving sheet from being fused with each other because of heat during the printing process. Preferable releasing agents can be exemplified like reactive curing type of silicone including which is made by the reaction between a silicone compound such as vinyl-modified silicone or amino-modified silicone and another silicone compound such as epoxy-modified silicone. The amount of the reactive curing type of silicone is preferably in a range of 0.5 to 20 wt % to an objective resin.

In order to raise the printing sensitivity of the dye receptor layer, there can be added plasticizers such as phthalate type, phosphate type or polyester type of plasticizer, which are normally used as plasticizer for the polyvinyl chloride resin and may have low to high molecular weight. A preferable amount of the plasticizers is in a range of 0.5 to 30 wt % to an objected resin.

The dye receptor layer is formed in a manner that a resin and various additives selected from foregoing materials are dissolved or dispersed in suitable solvent to prepare ink for forming the dye receptor layer, thus-prepared ink is coated on the surface of an objective substrate by a forming means such as the gravure printing method, screen printing method, or reverse-roll coating method adopting gravure plates, and thus-coated substrate is dried.

Still further, in forming the image-receiving sheet, a anti-static layer may be laminated on either of the front and/or back surfaces of the image-receiving sheet, or the front and/or back surfaces of its substrate. The anti-static layer is formed by a manner that anti-static agents, such as fatty esters, sulfates, phosphates, amides, quaternary ammonium salts, betaines, amino acids, acrylic resins, or ethylene oxide addition product, are dissolved or dispersed in a solvent to prepare a material for coating, whereby conducting the coating and drying process. A coating method for forming the anti-static layer is approximately the same in manner as one for forming the receptor layer. The coating amount of the anti-static layer is preferably 0.001 to 0.1 $g/m^2$ (dry state) when the layer is formed on the top surface of the image-receiving sheet, and preferably 0.1 to 10 $g/m^2$ (dry state) when the layer is formed in the interior (not the top surface) of the image-receiving sheet. Furthermore, the anti-static layers may be arranged both on the top surface and in the interior of the image-receiving sheet, which provides a more preferable state thanks to their higher anti-static effect.

Between the substrate and receptor layer of an image-receiving sheet, an intermediate layer comprising a wide range of resins can be interposed. Assigning different roles to the intermediate layer permits the image-receiving sheet to possess excellent other functions. For example, cushioning characteristics can be obtained by employing resins producing large amounts of elastic or plastic deformation, which include polyolefin resin, vinyl copolymer resin, polyurethane resin, and polyamide resin, thereby improving the printing sensitivity of the image-receiving sheet and avoiding roughness on an printed image. Alternatively, a anti-static capability can be assigned to the intermediate layer. This assignment is achieved by employing a manner; the foregoing anti-static agent is added into the resin for providing the cushioning characteristics, a mixture of the anti-static agent and the resins is dissolved or dispersed in a solvent to prepare a material for the intermediate layer, and thus-prepared material is coated to make the intermediate layer.

Still, in order that carrying performance of image-receiving sheets is improved, curling of image-receiving sheets is prevented or achieving the other objects, on the back surface of the substrate of an image-receiving sheet, there can be provided a back surface layer. Available materials as the back surface layer can be made, for example, by addition of the organic filler of polyamide resin or fluoro resin into the acrylic resin.

[Recording Method]

Image-printed materials according to the present invention can be produced using two kinds of recording methods when viewed systematically. One method is that a monolithic thermal transfer sheet and an image-receiving sheet are tiered up on each other, wherein the monolithic thermal transfer sheet includes a substrate, on one surface of which a dye layer and a white transfer layer are sequentially and alternately laminated, the white transfer layer provided with the white ink layer containing a white pigment and/or filler; dyes are migrated from the dye layer to the substrate or receptor layer of the image-receiving sheet through heating, thereby forming images; and the white transfer layer is thermal-transferred to the image-formed surface of the image-receiving sheet. In use of this method, the monolithic thermal transfer sheet having the dye layer and the white transfer layer is prepared, thus-prepared thermal transfer sheet and the image-receiving sheet are then tiered up on each other, and heat energy which is corresponds to an information of images (for example, mirror images, non-reverse images) to be printed is applied to the thermal transfer sheet by means of heating mediums such as a thermal head or laser. As a result, each of the yellow, magenta, cyan and/or black dyes is successively migrated to the substrate or receptor layer of the image-receiving sheet, thus forming images on the image-receiving sheet. Then, to the image-formed surface of the image-receiving sheet, the white transfer layer existing on the same surface of the substrate, on which the dye layer is laminated, is transferred by means of the heating mediums including the thermal head which has been used for forming the images (or another thermal head), laser, heat roll, xenon lamp or the like.

In the above, the dye images have been formed as mirror images, not non-reverse images. This is because, as pictorially shown in FIG. 4, image-printed materials formed using the above recording method are supposed to look the back of an image-formed portion 30 (that is, looking along a direction from the back surface layer 25 to the image-formed portion 30 with making a light source 40 for electric decoration light-emitting toward the protective layer 12 of the white transfer layer.

In contrast, dye images may be formed as non-reverse images, not limited to mirror images described above. In such case, a light source for electric decoration should be positioned to emit light toward the back surface layer of the sheet for the purpose of looking the side of the white transfer layer.

The other recording method is realized in a way that a thermal transfer sheet whose substrate has a dye layer thereon and an image-receiving sheet are tiered up on each other, and the dyes are migrated to the substrate or receptor layer of the image-receiving sheet through heating, thereby resulting in formation of images. After this, the image-formed surface of the image-receiving sheet and a white transfer layer, which is laminated on the substrate of another thermal transfer sheet and includes the white ink layer containing the white pigment and/or filler, are tiered up on each other so that the white transfer layer is transferred onto the image-formed surface through heating. In using this method, the thermal transfer sheet having the dye layer and the image-receiving sheet are tiered up on each other, and heat energy which is corresponds to an information of images (for example, mirror images because of the reason stated above) to be printed is applied to the thermal transfer sheet by means of heating mediums such as a thermal head or laser. In consequence, each of the yellow, magenta, cyan and/or black dyes is migrated in turn to the substrate or receptor layer of the image-receiving sheet, thereby forming images on the image-receiving sheet. Then, both the image-formed surface of the image-receiving sheet and a white transfer layer being disposed on the substrate of another thermal transfer sheet and including a white pigment and/or filler are tiered up on each other. In this state, heating mediums including the thermal head which has been used for forming images (or another thermal head), laser, heat roll, and xenon lamp are operated to transfer the white transfer layer.

[Image-Printed Material]

Image-printed material according to the third invention may be obtained with the use of thermal transfer sheets of the first invention and image-receiving sheets by carrying out the foregoing recording methods. FIG. 4 is a cross section view showing one example of image-printed materials according to the third invention.

In FIG. 4. there are formed images 30 in an image-printed material 7 and there is formed on the image-formed portion a white layer 8 equivalent to the white transfer layer of the thermal transfer sheet in conjunction with the first invention. Needless to say, the white layer 8 can be formed by transferring the white transfer layer. In addition, the white layer 8 may be formed by any methods other than the transfer processing.

A detailed layer construction of the image-printed material is shown in FIG. 4. That is, on one surface of a substrate of the image-receiving sheet, the anti-static layer 23, the intermediate layer 24, and the receptor layer 22 are successively laminated in this order, although on the other surface of the substrate, aback surface layer 25 is laminated. The image-formed portion 30 fixing the dyes migrated from the dye layer of the thermal transfer sheet is disposed in/on the receptor layer 22. Furthermore, as a white layer 8, the adhesive layer 14, white ink layer 13 and protective layer 12 are laminated in this order on the receptor layer 22. However, image-printed materials are not limited in layer construction to that shown in FIG. 4. For example, in cases where the substrate 21 has some additional functions, such as a anti-static function, cushioning property, anti-curling property, dye-receptive characteristic or carrying performance, the anti-static, intermediate, dye receptor, or back surface layers are not necessary to be laminated. Still, when one or more than one layer among anti-static, intermediate, dye receptor and back surface layers have more than one additional functions which have been supposed to be assigned to one or more than one other layers, such other layers can be omitted, if desired.

In the image-printed material shown in FIG. 4, a light source for electric decoration is to position so as to emit light toward the protective layer 12 of the white layer 8, on one hand, the images 30 are to be looked from positions facing the back surface layer 25 of the image-receiving sheet. The white layer 8, equivalent to the white transfer layer of the thermal transfer sheet, contains the white pigment and/or filler and has the total light transmittance of 30 to 95% as well as a haze of 30 to 95%, which results in producing light diffusion and light transmission suitably fitted for the image-printed material, that is, the electric-decorating display member.

EXAMPLE A

The followings are experimental example and comparative examples to describe the first and third present invention in more detail. In the sentences, parts and percentages are based on weight, unless otherwise noted.

Coating materials used for producing the thermal transfer sheets are prepared as shown in the following formulas:

| Composition of coating material for dye layer [Yellow ink] | |
|---|---|
| Diffusion dye (Phorone brilliant yellow S-6GL) | 5.5 parts |
| Binder resin (polyvinyl acetoacetal resin KS-5, available from Sekisui Kagaku Kogyo K.K.) | 4.5 parts |
| Polyethylene wax | 0.1 parts |
| Methyl ethyl ketone | 45.0 parts |
| Toluene | 45.0 parts |

[Magenta Ink]

In the above compositions of yellow ink, the diffusion dye is replaced by MS red of 1.5 parts and Macrolex red violet R of 2.0 parts. The remaining components are the same as yellow ink.

[Cyan Ink]

In the above compositions of yellow ink, the diffusion dye is replaced by Kayaset blue 714 of 4.5 parts. The remaining components are the same as yellow ink.

| Compositions of coating material for heat-resisting layer | |
|---|---|
| Polyvinyl butyral resin (ESLECK BX-1, available from Sekisui Kagaku K.K.) | 3.6 parts |
| Polyisocyanate (BARNOCK D750, available from Dai Nippon Ink K.K.) | 8.6 parts |
| Phosphate surface-active agent (PLYSURF A208S, available from Daiichi Kogyo Seiyaku K.K.) | 2.8 parts |
| Talc (MICROACE P-3, available from Nippon Talc K.K.) | 0.7 parts |
| Methyl ethyl ketone | 32.0 parts |
| Toluene | 32.0 parts |
| **Composition of coating material for releasing layer** | |
| Urethane resin (HYDRANE AP-40, available from Dai Nippon Ink Kogyo K.K.) | 2.0 parts |
| Polyvinyl alcohol (GOHSENOL C-500, available from Nippon Gosei Kagaku K.K.) | 3.0 parts |
| Fluorescent brightening agent (UVITEX CF, available from Ciba Geigy) | 0.1 parts |
| Water/Ethanol (2/1 by weight) | 90.0 parts |
| **Composition of coating material for protective layer** | |
| Acrylic resin (LP-45M, available from Soken Kagaku K.K.) | 20.0 parts |

-continued

| | |
|---|---|
| Fluorescent brightening agent (UVITEX OB, available from Ciba Geigy) | 0.1 parts |
| Polyethylene wax (average particle diameter 5 μm) | 0.1 parts |
| Methyl ethyl ketone/ Toluene (1/1 by weight) | 80.0 parts |
| **Composition of coating material for white ink layer No. 1** | |
| Urethane resin (N-5199, available from Nippon Polyurethane Kogyo K.K.) | 30.0 parts |
| Titanium oxide [anatase-type] (TCA888, available from Tochem products K.K.) | 60.0 parts |
| Fluorescent brightening agent (UVITEX OB, available from Ciba Geigy) | 0.1 parts |
| Methyl ethyl ketone/Toluene/ isopropyl alcohol (1/1/1 by weight) | 170.0 parts |
| **Composition of coating material for white ink layer No. 2** | |
| Urethane resin (N-5199, available from Nippon Polyurethane Kogyo K.K.) | 30.0 parts |
| Titanium oxide [anatase-type] (TCA888, available from Tochem products K.K.) | 30.0 parts |
| Fluorescent brightening agent (UVITEX OB, available from Ciba Geigy) | 0.1 parts |
| Methyl ethyl ketone/Toluene/ isopropyl alcohol (1/1/1 by weight) | 170.0 parts |
| **Composition of coating material for white ink layer No.3** | |
| Urethane resin (N-5199, available from Nippon Polyurethane Kogyo K.K.) | 30.0 parts |
| Titanium oxide [anatase-type] (TCA888, available from Tochem products K.K.) | 15.0 parts |
| Fluorescent brightening agent (UVITEX OB, available from Ciba Geigy) | 0.1 parts |
| Methyl ethyl ketone/Toluene/ isopropyl alcohol (1/1/1 by weight) | 170.0 parts |
| **Composition of coating material for white ink layer No.4** | |
| Urethane resin (N-5199, available from Nippon Polyurethane Kogyo K.K.) | 30.0 parts |
| Titanium oxide [rutile-type] (TCR18, available from Tochem products K.K.) | 60.0 parts |
| Fluorescent brightening agent (UVITEX OB, available from Ciba Geigy) | 0.1 parts |
| Methyl ethyl ketone/Toluene/ isopropyl alcohol (1/1/1 by weight) | 170.0 parts |
| **Composition of coating material for adhesive layer** | |
| Vinyl chloride-vinyl acetate copolymer (#1000ALK, available from Denki Kagaku Kogyo K.K.) | 20.0 parts |
| Fluorescent brightening agent (UVITEX OB, available from Ciba Geigy) | 0.1 parts |
| Methyl ethyl ketone/ Toluene (1/1 by weight) | 130.0 parts |

In addition, various coating materials used for producing an image-receiving sheet are prepared as shown in the following formulas:

| Composition of coating material for anti-static layer | |
|---|---|
| Cation acrylic resin (ELECOND PQ50B, available from Soken Kagaku K.K.) | 20.0 parts |
| Methanol/Ethanol (1/1 by weight) | 80.0 parts |
| **Composition of coating material for intermediate layer** | |
| Vinyl chloride-Vinyl acetate copolymer (#1000GK, available from Denki Kagaku Kogyo K.K.) | 20.0 parts |
| Methyl ethyl Ketone/ Toluene (1/1 by weight) | 80.0 parts |
| **Composition of coating material for receptor layer** | |
| Vinyl chloride-Vinyl acetate copolymer (#1000A, available from Denki Kagaku Kogyo K.K.) | 20.0 parts |

-continued

| | |
|---|---|
| Amino-modified silicone (KF-393, available from Shinetsu Kagaku Kogyo K.K.) | 0.5 parts |
| Epoxy-modified silicone (X-22-343, available from Shinetsu Kagaku Kogyo K.K.) | 0.5 parts |
| Methyl ethyl ketone/ Toluene (1/1 by weight) | 80.0 parts |
| Compositions of coating material for back surface layer | |
| Acrylic polyol resin (ACRYDICK 47-538, available from Dai Nippon Ink Kagaku Kogyo K.K.) | 30.0 parts |
| Isocyanate hardening agent (TAKENATE A-14, available from Takeda Yakuhin K.K.) | 3.0 parts |
| Polyamide resin particle (MW-330, available from Jinto Toryo K.K.) | 0.1 parts |
| Catalyst (S-CAT24, available from Sankyo Yuki Gosei K.K.) | 0.1 parts |
| Methyl ethyl ketone/Toluene/ Butyl acetate (3/3/1 by weight) | 70.0 parts |

EXAMPLE A-1

First, onto one surface of a substrate (made of PET) having a thickness of 6 μm, the foregoing coating material for heat-resisting layer was coated by a gravure printing machine and dried to form a heat-resisting layer of a coating thickness of 1 μm in the dried state. Further, the layer had been hardened by heating and aging in an oven at 60° C. for five days.

Onto the other surface of the substrate having the heat-resisting layer, the foregoing coating materials for the dye layer was coated by a gravure printing machine and dried to form the dye layer of a coating thickness of 1 μm in the dried state, thereby obtaining a thermal transfer sheet having the dye layer being aligned sequentially and alternately (color by color) thereon as shown in FIG. 2.

Second, onto one surface of another substrate (made of PET and having a thickness of 6 μm), the foregoing coating material for heat-resisting layer was coated in the same manner as the first process to form a heat-resisting layer of a coating thickness of 1 μm in the dried state. Subsequently, onto the other surface of the substrate having the heat-resisting layer, the foregoing coating material for releasing layer was coated by a gravure printing machine and then dried to form the releasing layer whose coating thickness is 0.2 μm in dried state. Onto thus-formed releasing layer, the foregoing coating material for protective layer was coated and then dried to form the protective layer of a thickness of 1.5 μm in the dried state. Further, onto the protective layer, the foregoing coating material for white ink layer No.1 was coated and then dried to form the white ink layer of a thickness of 0.8 μm in the dried state. Still further, onto the white ink layer, the foregoing coating material for adhesive layer was coated and then dried to form an adhesive layer of a thickness of 1.0 μm in the dried state. A series of these steps realized a thermal transfer sheet of the present first invention.

Third, an image-receiving sheet was prepared as follows. Onto one surface of a substrate made of transparent PET having a thickness of 125 μm, the foregoing coating material for anti-static layer was coated to form the anti-static layer of a thickness of 7.0 μm in the dried state. Onto thus-formed anti-static layer, the above-described coating material for intermediate layer was coated and then dried to form the intermediate layer having a thickness of 6.0 μm in the dried state. Still, onto the intermediate layer, the foregoing coating material for receptor layer was coated and then dried to form the receptor layer of a 5.0 μm thickness in the dried state. In contrast, onto the other surface of the substrate, the foregoing coating material for back surface was coated and then dried to form a back surface layer of a 8.0 μm thickness in the dried state, with the result that the image-receiving sheet was prepared.

EXAMPLE A-2

In this example, thermal transfer sheets and an image-receiving sheet were obtained by a manner that the coating material for white ink layer No.1 used in the Example A-1 was replaced with the foregoing coating material for white ink layer No.2 and the remaining ones used in the Example A-1 were unchanged.

EXAMPLE A-3

In this example, thermal transfer sheets and an image-receiving sheet were obtained by a manner that the coating material for white ink layer No.1 used in the Example A-1 was replaced with the foregoing coating material for white ink layer No.3 and the remaining ones used in the Example A-1 were unchanged.

COMPARATIVE EXAMPLE a-1

Thermal transfer sheets and an image-receiving sheet were obtained by such a manner that the coating material for white ink layer No.1 used in the Example A-1 was changed to the foregoing coating material for white ink layer No.4 and a thickness of the white ink layer was changed to 2.0 μm in dried state, and the remaining ones used in the Example A-1 were unchanged.

COMPARATIVE EXAMPLE a-2

Thermal transfer sheets and an image-receiving sheet were formed by the same way as in Example A-1, except that the white ink layer was not laminated.

[Test and Result]

Using the thus-prepared thermal transfer sheets each having the white transfer layer, on the basis of the method provided in JIS K7105, measured were amounts of total light transmittance and diffusion transmittance each associated with the portion of the white transfer layer. A value of haze was calculated on those amounts.

Next, The thermal transfer sheet having dye layer and image-receiving sheet obtained in experimental examples and comparative examples were tiered up with each other, in a state that the dye layer of the thermal transfer sheet and the receptor layer of the image-receiving sheet made contact to each other. By employing a printer being capable of controlling 256 gradations and incorporating a thermal head of a line density of 300 dpi, color images were printed in yellow, magenta and cyan colors. The printing conditions included a printing speed of 10 ms/line and an amount of applying energy of 0.65 mJ/dot for the max. gradation. Additionally, using the thermal transfer sheet having the white transfer layer, which is produced in the respective experimental examples and comparative examples, the white transfer layer was transferred by means of a thermal head onto the receptor layer holding the images formed, to produce an image-printed material. An amount of applying energy for this transfer process was 0.55 mJ/dot.

Using the thus-produced image-printed materials, the maximum transmission density at the tier portion (black portion) regarding three colors consisting of yellow, magenta and cyan and the transmission density at the non-printed portion (white background) were measured with Macbeth's transmission-reflection densitometer TR924 in the Status A.

Further, each of the image-printed materials was applied to an electric-decorating apparatus to visually evaluate their image quality needed to electric-decorating display members under the following evaluation criteria.

Criteria for Evaluating Quality of Electric-Decorating Images

○: remarkably excellent appearance

Δ: not so good appearance

Results of Evaluation

The results of evaluation for Example A are shown in Table 1.

TABLE 1

| | Total light transmittance (%) | Diffusion transmittance (%) | Haze (%) |
|---|---|---|---|
| Example A-1 | 62.8 | 53.9 | 85.8 |
| Example A-2 | 67.7 | 57.2 | 84.5 |
| Example A-3 | 76.8 | 55.5 | 72.3 |
| Comparative Example a-1 | 45.5 | 40.8 | 89.7 |
| Comparative Example a-2 | 85.7 | 11.4 | 13.3 |

| | Max Density at 3-colors tiered up (%) | Density at non-printed portion (%) | Image Quality |
|---|---|---|---|
| Example A-1 | 1.89 | 0.22 | ○ |
| Example A-2 | 1.86 | 0.19 | ○ |
| Example A-3 | 1.75 | 0.14 | ○ |
| Comparative Example a-1 | 2.04 | 0.35 | Δ*1 |
| Comparative Example a-2 | 1.49 | 0.02 | Δ*2 |

Notes:

*1Since light emitted from a light source is interrupted by the display member, a slightly dark impression is given compared with the Examples.

*2On account of extreme transparency, un-uniformity in brightness of a light source is directly observed.

The evaluation results for the above image quality shows that when the image-printed materials have an appropriate light diffusion and light transmission themselves, quality of images as electric-decorating display members respondingly becomes superior in appearance.

As shown in Comparative example a-1, it is understood that when the total light transmittance becomes lower, the transmission density at non-printed part becomes higher, thereby darkening images as being electric-decorating display members.

From comparative example a-2, it is also understood that lower haze values give rise to higher transparency, so that the background to printed and non-printed part is to be seen to make it conspicuous un-uniformity in brightness of a light source.

A thermal transfer sheet according to the second invention and an image-printed material according to the fourth invention will now be explained below. The thermal transfer sheet according to the second invention may be formed into either type of the monolithic type shown in FIG. 1 or the separate type shown in FIG. 2, like the thermal transfer sheet of the first invention.

Figure 5:
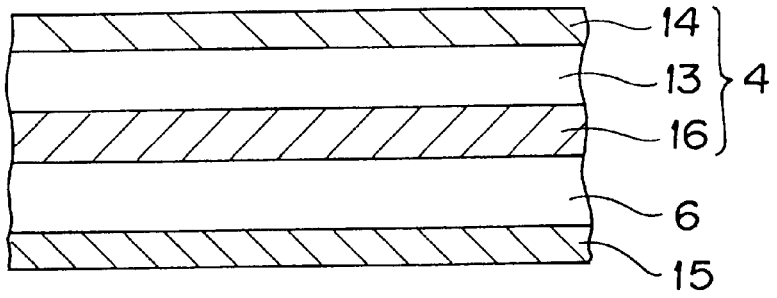
FIG. 5 is a schematic sectional view indicative of one example of white transfer layers according to the second invention.

As concerning the thermal transfer sheet of the second invention, the white transfer layer 4 has a layer construction exemplified by FIG. 5. Namely, a peeling layer 16, white ink layer 13, and adhesive layer 14 are in turn laminated on one surface of a substrate 6 in this order when viewing from the substrate 6. Still, a heat-resisting layer 15 is laminated on the other surface of the substrate 6. However, the white transfer layer requires only the peeling and white ink layers as its indispensable elements included therein. The remaining layers may be added or omitted depending on necessity.

As to the thermal transfer sheet of the second invention, other layers other than the peeling layer and the protective layer, for example, the substrate 6, white ink layer 13, adhesive layer 14, and heat-resisting layer 15 can be prepared, formed or handled in the same manner as in the thermal transfer sheet of the first invention.

When the surface of the substrate has poor adhesiveness with the peeling layer, for the purpose of increasing adhesiveness between the substrate 6 and the peeling layer thereby promoting cohesive failure, it is preferred that the surface of substrate is treated with primer processing (adhesion-facilitating processing) or corona discharge processing.

[White Transfer Layer of Thermal Transfer Sheet of the Second Invention]

In the second invention, a main function of the white transfer layer 4 is to provide suitable light diffusion and light transmission for the image-printed material (i.e. electric-decorating display member) to which the white transfer layer 4 is transferred. As shown in FIG. 5, the white transfer 4 is normally provided with the peeling layer 16 for smoothly peeling the white transfer layer 4 from the substrate 6, the white ink layer 13 for providing suitable light diffusion and light transmission, and the adhesive layer 14 for improving adhesiveness of the white transfer layer 4 with an image-receiving sheet when it is transferred. The white transfer layer 4 requires at least the peeling layer 16 and white ink layer 13 as its essential elements, but can omit the adhesive layer, if desired. Alternatively, the white ink layer itself may additionally have performance of the adhesive layer by having suitably designed adhesiveness.

Alternatively, although it is not shown, in order to more improve such durability as scuff resistance and resistance to plasticizer, there may be employed a protective layer arranged between the peeling layer 16 and the white ink layer

[Protective Layer of Thermal Transfer Sheet of the Second Invention]

The protective layer is capable of enhancing durability including water resistance, scuff resistance, resistance to fingureprints, and resistance to plasticizer of images, and others. The protective layer is formed of resin composition which contains at least a binder resin, and has enough adhesiveness with the peeling and white ink layers and has high durability. As materials for the protective layer, selected are resin compositions having desired physical properties fit for the surface protective layer of a receptor layer when transferred onto an image-receiving sheet. Typical resins which can be used as the protective layer are cellulose derivatives such as ethyl cellulose, nitrocellulose or cellulose acetate; acrylic resin such as polymethyl methacrylate, polyethyl methacrylate or polybutyl methacrylate; vinyl resin such as polyvinyl acetate, vinyl chloride-vinyl acetate copolymer, polyvinyl alcohol or polyvinyl butyral; and thermosetting resins such as polyester resin or polyurethane resin.

In cases where an image-printed material to which the white transfer layer is transferred particularly requires scuff resistance, resistance to chemicals, and stain resistance, ionizing radiation hardenable resins can be used as resins for the protective layer.

In addition, into each of the above-mentioned resins, it is also possible to add organic or inorganic fillers, ultraviolet absorbers, oxidation inhibitors and/or fluorescent brightening agents.

The forming processing as one used for the dye layer or the protective layer of the first invention can be applied to the protective layer of the second invention. A preferable thickness of the protective layer is 0.1 to 5.0 $\mu$m in the dried state.

[Peeling Layer of the Second Invention]

The peeling layer 16 included in the white transfer layer 4 prevents the thermal transfer sheet and image-receiving sheet from being fused with each other when they are heated by means of a thermal head or other heating means. In consequence, the substrate of the thermal transfer sheet will smoothly peel off from the image-receiving sheet at the time of thermal transfer, thereby excluding ununiformity of the transfer and providing favorable transferring performance.

Figure 6:
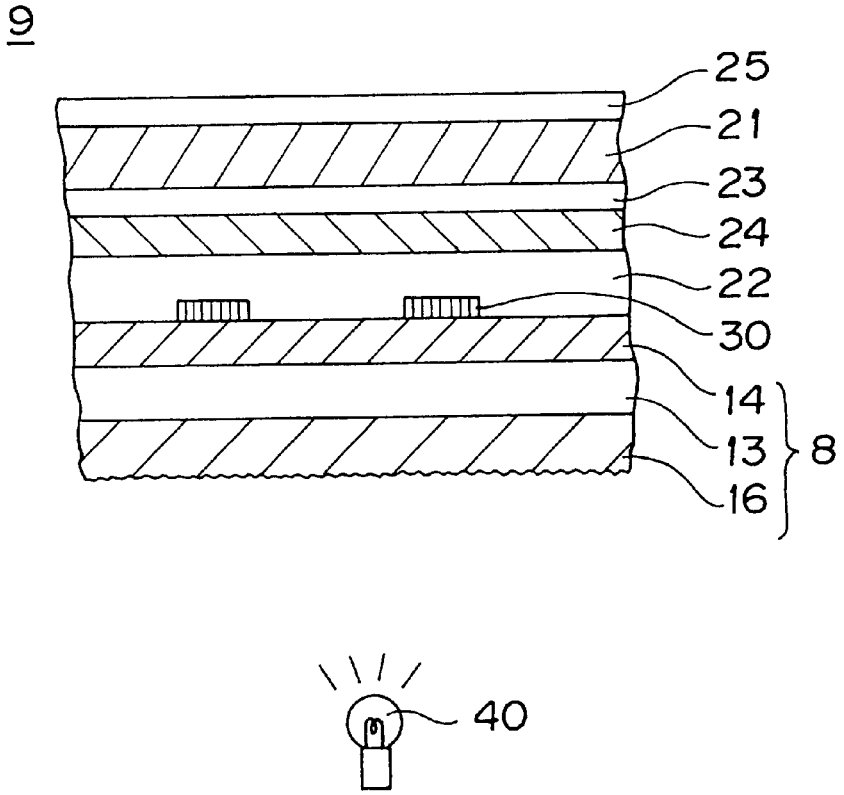
FIG. 6 is a schematic sectional view indicative of one example of image-printed materials according to the fourth invention.
Figure 7:
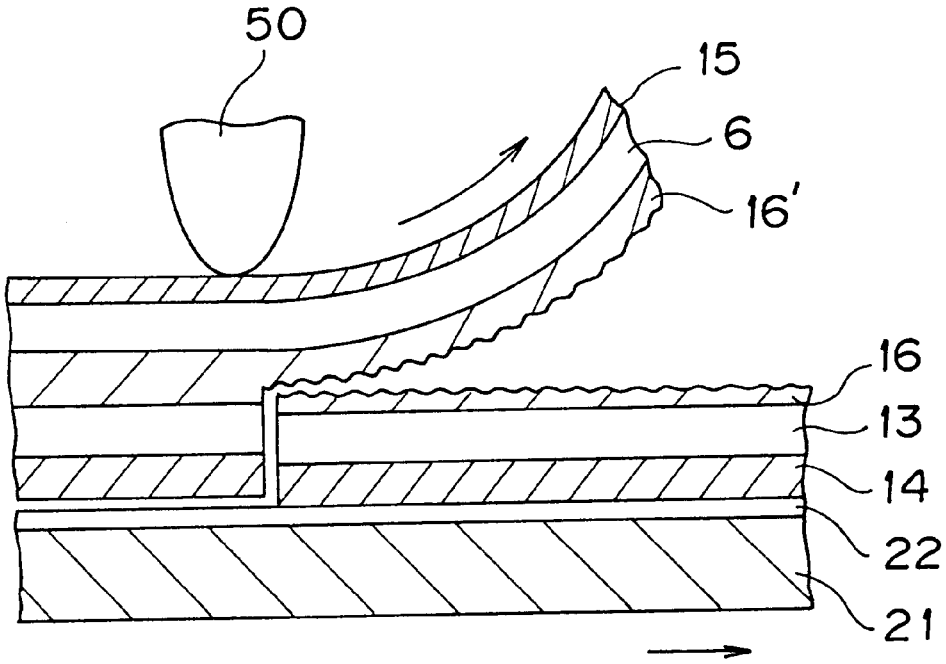
FIG. 7 schematically shows the transfer process employing a thermal transfer sheet according to the second invention.

As pictorially shown in FIG. 6, when the white transfer layer 16 is transferred from the thermal transfer sheet to the image-receiving sheet, the peeling layer 16 will cause, what is called, cohesive failure at the intermediate position or thereabout in the direction along its thickness and transfer to the image-receiving sheet, thereby forming the top surface of the image-printed material. Alternatively, after transferring the white transfer layer to the image-printed materials, another layer which is like the protective layer may additionally be laminated on the peeling layer. The transfer will cause irregularities on the surface of the peeling layer which is transferred to image-printed materials. In other words, as shown in FIG. 7, when the thermal transfer sheet having the white transfer layer and the image-receiving sheet are tiered up such that the adhesive layer 14 of the former and the image-receiving layer 22 of the latter make contact with each other, and the white transfer layer is transferred to the image-receiving sheet by heating such means as the thermal head 50, the peeling layer 16 will cause cohesive failure immediately after its thermal transfer, thus the top surface of the image-printed material becoming irregular in its thickness direction. On one hand, on the thermal transfer sheet which completed the transfer, there remains a remaining portion 16' of the peeling layer whose peeled portion was transferred to the image-receiving sheet. An arrow in FIG. 7 represents a traveling direction of both the thermal transfer and image-receiving sheets during being peeled off, after heated by a thermal head 50 etc. in the tiered state of both the sheets.

The irregular surface of the peeling layer which transferred to image-printed materials diffuses and reflects light emitted from an electric-decorating light source, thus making up for light diffusion at the white ink layer included in the white transfer layer. Therefore, image-printed materials depending on the present invention have a combination of favorable light diffusion and favorable light transmission and can be used as electric-decorating display members which have favorable appearance.

By the way, in cases where the white ink layer is primarily in charge of achieving both light diffusion and light transmission, the compatibility between them is difficult. In such case, to improve light diffusion, it will be forced to increase the thickness of the white ink layer or to increase the content of the white pigment/or filler, but this will lead to poor light transmission. Namely, it is extremely difficult to satisfy both characteristics of the light diffusion and light transmission at the same time.

Thus, the present invention is effective in avoiding such a drawback. As stated before, the peeling layer having irregularities on its surface, which becomes the top surface of an image-printed material, makes up for and helps to raise the light diffusion, without deterioration of the light transmission. As a result, there are provided image-printed materials favorable to electric-decorating display members which need good appearance of images.

The peeling layer 16 is constructed, for example, with addition of a releasing material into a binder resin depending on its necessity. Materials which can be used as the binder resin include thermoplastic resins and thermosetting resins. Examples of the thermoplastic resins are acrylic resins such as polymethyl methacrylate, polyethyl methacrylate or polybutyl acrylate; vinyl resins such as polyvinyl acetate, vinyl chloride-vinyl acetate copolymer, polyvinyl alcohol or polyvinyl butyral; and cellulose derivatives such as ethyl cellulose, nitrocellulose or cellulose acetate. Example of the thermosetting resins are polyester resins; and polyurethane resins. Additionally it is also possible to produce the peeling layer based on compositions made up of one or more than one kinds of resins selected from the above-exemplified resins. To avoid fusing with the substrate in thermal transfer processing, it is preferable to use the binder resin made up of resins having a Tg or softening point of not less than 100° C. Although a resin has a Tg or softening point of less than 100° C., such resin can be also used as the binder resin for the peeling layer by combining it with appropriately selected releasing materials.

As releasing materials, there can be employed such inorganic or organic fine particles as wax, talc, or silica. Further, in order to facilitate the occurrence of cohesive failure in the peeling layer in thermal transfer processing, preferable is that the peeling occurs at the interface made between the releasing material and the binder resin.

It is preferably suggested that the releasing material of 0.1 to 200 wt % to the binder resin be added. Particularly preferable amount of the releasing material is 10 to 100 wt % to the binder resin.

When the releasing material is not used in the peeling layer, it is preferable that two or more than two kinds of binder resins listed above should be used. In such case, preferable is that compatibility between the binder resins is low so as to peel off at the interfaces between the binder resins.

In addition to the above-exemplified materials favorable to the peeling layer, an, ultraviolet absorber, oxidation inhibitor, and fluorescent brightening agent (stilbene, pyrazoline) can be added for the purpose of enhancing weathering performance.

Further, a white pigment and/or filler can be added into the peeling layer. When such addition is performed, selecting an appropriate combination of a binder resin, releasing material, white pigment and/or filler makes it possible to be used the peeling layer and white ink layer as one layer. Also, such addition makes it possible that the peeling layer to which the white pigment and/or filler are added makes up for the light diffusion and light transmission.

The peeling layer can be formed by the same method used in the dye layer in the first invention and is preferable in a range of 0.1 to 5.0 $\mu$m in thickness after coating and drying.

[Image-Printed Material of the Fourth Invention]

Image-printed materials of the fourth invention can be obtained by using the thermal transfer sheet of the second invention and the image-receiving sheet and by employing the foregoing recording method of the second invention. FIG. 6 shows one example concerning of the image-printed material 9.

In FIG. 6, a image-formed portion 30 is disposed on/in a receptor layer 22 of the image-printed material 9, and a white layer 8 is formed on the receptor layer 22 so as to cover the image-formed portion 30. The white layer 8 is equivalent to the white transfer layer 4 provided for the thermal transfer sheet of the second invention as shown in FIG. 5. Needless to say, the white layer 8 can be formed by transferring the white transfer layer. Besides, the white layer 8 may be formed through methods other than the transfer method. One example is that a layer which is able to cause the cohesive failure is laminated on the surface of an image-printed material and then the surface of the layer is subject to cohesive failure to produce irregularities on the surface of the image-printed material.

In FIG. 6, a detailed layer construction of the image-printed material is shown. That is, on one surface of a substrate 21 of the image-receiving sheet 9, a anti-static layer 23, a intermediate layer 24, and a receptor layer 22 are successively laminated in this order, although on the other surface of the substrate 21, a back surface layer 25 is laminated. Dyes migrated from the dye layer 5 of the thermal transfer sheet form an image-formed portion 30 in/on the receptor layer 22. Furthermore, on the receptor layer 22, an adhesive layer 14, a white ink layer 13 and a peeling layer 16 handled as a white layer 8 are laminated in this order. However, image-printed materials are not limited in layer construction to that shown in FIG. 6. For example, in cases where the substrate 21 itself has some additional functions, such as a anti-static function, cushioning and/or anti-curling property, dye-receptive characteristic or carrying performance, the anti-static, intermediate, receptor or back surface layer are not necessary to be laminated. Still, when one or more than one layers among anti-static, intermediate, receptor and back surface layers have more than one additional functions to their original functions which have been supposed to be assigned to one or more than one other layers, such other layers can be omitted, if desired.

For the image-printed material whose image is a mirror image, as shown in FIG. 6, an electric-decorating light source 40 is to radiate light toward the peeling layer 16 of the white transfer layer and the images 30 are to be observed or appreciated from the side of the back surface layer 25. Meanwhile, for the image-printed material whose image is a non-reverse image, light is radiated toward the back surface layer 25 thereof and the images 30 are to be seen from the side of the peeling layer 16. In the image-printed material 9, first of all, the white ink layer 13 containing the white pigment/filler adjusts the light diffusion and light transmission. Secondly, the peeling layer 16 having the irregular surface compensates for the light diffusion of the white ink layer 13, thus providing suitably balanced excellence in both the light diffusion and the light transmission. This balance is favorable to electric-decorating display members. When the white layer including at least the white ink layer and peeling layer is offered the total light transmittance of 30 to 95% and the haze of 30 to 95%, the light diffusion and the light transmission is particularly well-balanced with each other.

EXAMPLE B

The followings are experimental examples and comparative examples to describe the second and fourth invention in more detail. In the sentences, parts and percentages are based on weight, unless otherwise noted.

Coating materials used for producing the thermal transfer sheet are prepared as shown in the following formulas:

Composition of coating material for dye layer

[Yellow ink]

| | |
|---|---|
| Diffusion dye (Phorone brilliant yellow S-6GL) | 5.5 parts |
| Binder resin (polyvinyl acetoacetal resin KS-5, available from Sekisui Kagaku Kogyo K.K.) | 4.5 parts |
| Polyethylene wax | 0.1 parts |
| Methyl ethyl ketone | 45.0 parts |
| Toluene | 45.0 parts |

[Magenta ink]

In the above compositions of yellow ink, the diffusion dye is replaced by MS red of 1.5 parts and Macrolex red violet R of 2.0 parts. The remaining compositions are the same as yellow ink.

[Cyan ink]

In the above compositions of yellow ink, the diffusion dye is replaced by KAYASET blue 714 of 4.5 parts. The remaining compositions are the same as yellow ink.

Compositions of coating material for heat-resisting layer

| | |
|---|---|
| Polyvinyl butyral resin (ESLECK BX-1, available from Sekisui Kagaku K.K.) | 3.6 parts |
| Polyisocyanate (BARNOCK D750, available from Dai Nippon Ink K.K.) | 8.6 parts |
| Phosphate surface-active agent (PLYSURF A208S, available from Daiichi Kogyo Seiyaku K.K.) | 2.8 parts |
| Talc (MICROACE P-3, available from Nippon Talc K.K.) | 0.7 parts |
| Methyl ethyl ketone | 32.0 parts |
| Toluene | 32.0 parts |

Composition of coating material for peeling layer

| | |
|---|---|
| Acrylic resin (LP-45M, available from Soken Kagaku K.K.) | 16.0 parts |
| Polyethylene wax (average particle diameter: approximate 1.1 $\mu$m) | 8.0 parts |
| Toluene | 76.0 parts |

Composition of coating material for white ink layer

| | |
|---|---|
| Modified acrylic resin (ACRYDICK BZ-1160, available from Dai Nippon Ink K.K.) | 20.0 parts |
| Titanium oxide | 40.0 parts |
| Fluorescent brightening agent (UVITEX OB, available from Ciba Geigy) | 0.3 parts |
| Toluene/isopropyl alcohol (1/1 by weight) | 40.0 parts |

Composition of coating material for adhesive layer

| | |
|---|---|
| Vinyl chloride-vinyl acetate copolymer resin (#1000 ALK, available from Denki Kagaku Kogyo K.K.) | 20.0 parts |
| Silica | 1.0 parts |
| Fluorescent brightening agent (UVITEX OB, available from Ciba Geigy) | 0.1 parts |
| Methyl ethyl Ketone/Toluene (1/1 by weight) | 80.0 parts |

Composition of coating liquid for protective layer

| | |
|---|---|
| Acrylic resin (LP-45M, available from Soken Kagaku K.K.) | 20.0 parts |
| Methyl ethyl Ketone/Toluene (1/1 by weight) | 80.0 parts |

Further, various coating materials used for forming the image-receiving sheet are prepared as shown in the following formulas:

Composition of coating material for anti-static layer

| | |
|---|---|
| Cation acrylic resin (ELECOND PQ50B, available from Soken Kagaku K.K.) | 20.0 parts |
| Methanol/Ethanol (1/1 by weight) | 80.0 parts |

-continued

| Composition of coating material for intermediate layer | |
|---|---|
| Vinyl chloride-vinyl acetate copolymer resin (#1000GK, available from Denki Kagaku Kogyo K.K.) | 20.0 parts |
| Methyl ethyl Ketone/Toluene (1/1 by weight) | 80.0 parts |
| **Composition of coating material for receptor layer** | |
| Vinyl chloride-vinyl acetate copolymer resin (#1000A, available from Denki Kagaku Kogyo K.K.) | 20.0 parts |
| Amino-modified silicone (KF-393, available from Shinetsu Kagaku Kogyo K.K.) | 0.5 parts |
| Epoxy-modified silicone (X-22-343, available from Shinetsu Kagaku Kogyo K.K.) | 0.5 parts |
| Methyl ethyl ketone/Toluene (1/1 by weight) | 80.0 parts |
| **Compositions of coating material for back surface layer** | |
| Acrylic polyol resin (ACRYDICK 47-538, available from Dai Nippon Ink Kagaku Kogyo K.K.) | 30.0 parts |
| Isocyanate hardening agent (TAKENATE A-14, available from Takeda Yakuhin K.K.) | 3.0 parts |
| Polyamide resin particle (MW-330, available from Jinto Toryo K.K.) | 0.1 parts |
| Catalyst (S-CAT24, available from Sankyo Yuki Gosei K.K.) | 0.1 parts |
| Methyl ethyl ketone/Toluene/ Butyl acetate (3/3/1 by weight) | 70.0 parts |

EXAMPLE B-1

First, a separate-type thermal transfer sheet having the dye layer is formed. Used is a substrate, whose one surface is treated with pre-adhesive processing, being made of PET and having a thickness of 6 μm. Onto the other surface of the substrate, the foregoing coating material for heat-resisting layer was previously coated by a gravure printing machine and dried to form a heat-resisting layer of a coating thickness of 1 μm in the dried state. Further, the layer had been hardened by heating and aging it in an oven at 60° C. for five days.

Onto the pre-adhesive processing surface of the substrate to which the heat-resisting layer had been applied, the foregoing coating materials for dye layer was coated by a gravure printing machine and dried to form a thermal transfer sheet having thereon the dye layer of a coating thickness of 1 μm in the dried state, the dye layer being aligned sequentially and alternately (color by color) as shown in FIG. 2.

Second, a separate-type thermal transfer sheet having the white transfer layer is formed. Prepared is another substrate being the same as the first process is prepared, that is, which is made of PET and has a thickness of 6 μm, whose one surface is subjected to the pre-adhesive processing, and whose another surface is provided with the heat-resisting layer having a thickness of 1 μm in the dried state.

Onto the pre-adhesive processing surface of the substrate, the foregoing coating material for peeling layer was coated by the gravure printing machine and then dried to form a peeling layer whose coating thickness is 0.6 μm in the dried state. Onto the peeling layer, the foregoing coating material for white ink layer was then coated by the gravure printing machine to form a white ink layer of a thickness of 2.0 μm in the dried state. This supplied a thermal transfer sheet of the invention.

Third, an image-receiving sheet was prepared as follows. Onto one surface of a substrate composed of transparent PET having a thickness of 125 μm, the foregoing coating material for anti-static layer was coated to form a anti-static layer of a thickness of 2.0 μm in the dried state. Onto the anti-static layer, the above-described coating material for intermediate layer was then coated to form an intermediate layer having a thickness of 3.0 μm in the dried state. Still, onto the intermediate layer, the foregoing coating material for receptor layer was coated to form a receptor layer of a 3.0 μm thickness in the dried state. In contrast, onto the other surface of the substrate, the foregoing coating material for back surface layer was coated so as to form a back surface layer of a 6.0 μm thickness in the dried state, with the result that the image-receiving sheet was prepared.

EXAMPLE B-2

In this example, a thermal transfer sheet having the peeling layer was produced in the same manner as Example B-1, except that a thickness of the peeling layer was changed into 0.3 μm (dried state).

A thermal transfer sheet having the dye layer and an image-receiving sheet was prepared through the same method as Example B-1.

EXAMPLE B-3

In this example, a thermal transfer sheet having the peeling layer was produced in the same manner as Example B-1, except that a adhesive layer having a thickness of 0.6 μm (dry basis) was formed on the white ink layer by coating the foregoing coating material for adhesive layer on the white ink layer and then drying.

A thermal transfer sheet having the dye layer and an image-receiving sheet was prepared through the same method as Example B-1.

EXAMPLE B-4

In this example, a thermal transfer sheet having the peeling layer was produced in the same manner as Example B-1, except that a protective layer having a thickness of 0.5 μm (dry basis) was formed between the peeling layer and the white ink layer by coating the foregoing coating material for protective layer on the peeling layer and then drying, thereafter coating the coating material for white ink layer on thus-formed protective layer.

A thermal transfer sheet having the dye layer and an image-receiving sheet was prepared through the same method as Example B-1.

EXAMPLE B-5

In this example, a thermal transfer sheet having thee peeling layer was produced in the same manner as Example B-4, except that a adhesive layer having a thickness of 0.6 μm (dried state) was formed on the white ink layer by coating the foregoing coating material for adhesive layer on the white ink layer and then drying.

A thermal transfer sheet having the dye layer and an image-receiving sheet was prepared through the same method as Example B-1.

COMPARATIVE EXAMPLE b-1

Used was a substrate made of PET and having a thickness of 6 μm. Onto one surface of the substrate, the heat-resisting layer having 1 μm (dried state) was formed in the same manner as Example B-1, however, no surface of the substrate is subjected to the pre-adhesive processing.

Onto a surface having no heat-resisting layer, the foregoing coating material for protective layer was coated to form a protective layer of 0.5 μm in thickness (dried state). Furthermore, onto thus-formed protective layer, a white ink layer having a thickness of 2.0 μm was formed in the same manner as Example B-1, thereby producing the thermal transfer sheet having the white ink layer.

A thermal transfer sheet having the dye layer and an image-receiving sheet was prepared through the same method as Example B-1.

COMPARATIVE EXAMPLE b-2

In this example, a thermal transfer sheet, which had the protective layer and the adhesive layer but the white ink layer, was produced in the same manner as Example b-1, except that onto the protective layer, a adhesive layer having a thickness of 0.6 μm (dried state) was formed instead of the white ink layer by coating the foregoing coating material for adhesive layer on the protective layer and then drying.

A thermal transfer sheet having the dye layer and an image-receiving sheet was prepared through the same method as Example B-1.

COMPARATIVE EXAMPLE b-3

In this example, a thermal transfer sheet having the white ink layer was produced in the same manner as Example b-1, except that a thickness of the white ink layer was changed into 3.0 μm (dried state).

A thermal transfer sheet having the dye layer and an image-receiving sheet was prepared through the same method as Example B-1.

[Test and Result]

Using the thus-prepared thermal transfer sheets each having the white transfer layer, on the basis of the method provided in JIS K7105, measured were amounts of total light transmittance and diffusion transmittance each associated with the portion of the white transfer layer. A value of haze was calculated on those amounts.

Next, The thermal transfer sheet having dye layer and image-receiving sheet obtained in experimental examples and comparative examples were tiered up with each other; in a state that the dye layer of the thermal transfer sheet and the receptor layer of the image-receiving sheet made contact to each other. By employing a printer being capable of controlling 256 gradations and incorporating a thermal head of a line density of 300 dpi, color images were printed in yellow, magenta and cyan colors. The printing conditions included a printing speed of 10 ms/line and an amount of applying energy of 0.65 mJ/dot for the max. gradation. Additionally, using the thermal transfer sheet having the white transfer layer, which is produced in the respective experimental examples and comparative examples, the white transfer layer was transferred by means of a thermal head onto the receptor layer holding the images formed, to produce an image-printed material. An amount of applying energy for this transfer process was 0.55 mJ/dot.

Using the thus-produced image-printed materials, measured were quantities of gloss on the peeling layer which positions as the top surface of the transferred white transfer layer. The measurement was done depending on the mirror gloss of 60 degrees provided in JIS Z 8741.

Further, each of the image-printed materials was applied to an electric-decorating apparatus to visually evaluate their image quality needed to electric-decorating display members under the following evaluation criteria.

Criteria for Evaluating Quality of Electric-Decorating Images

⊙: remarkably excellent appearance

○: excellent appearance

Δ: not so good appearance

Results of Evaluation

The results of evaluation for Example B are shown in Table 2.

TABLE 2

| | Gloss [60 degrees] (%) | Total light trans-mittance (%) | Diffusion trans-mittance (%) | Haze (%) | Image Quali ty |
|---|---|---|---|---|---|
| Example B-1 | 8.5 | 55.7 | 50.1 | 90.0 | ⊙ |
| Example B-2 | 12.1 | 55.3 | 49.6 | 89.7 | ⊙ |
| Example B-3 | 8.3 | 55.4 | 49.8 | 89.9 | ⊙ |
| Example B-4 | 8.6 | 55.5 | 49.8 | 89.7 | ⊙ |
| Example B-5 | 8.4 | 54.9 | 49.3 | 89.8 | ⊙ |
| Comparative Example b-1 | 85.0 | 53.2 | 45.1 | 85.6 | ○ |
| Comparative Example b-2 | 88.5 | 85.5 | 9.6 | 11.2 | Δ |
| Comparative Example b-3 | 83.7 | 48.2 | 43.5 | 90.2 | Δ |

Comparison between the Examples B-1 and B-2 shows that the peeling layer in Example B-1 is slightly glossier than in the Example B-2, due to the fact that the peeling layers are 0.6 μm and 0.3 μm in thickness, respectively. However, compared with the comparative Example b-1 etc. which do not have such peeling layer accompanying the cohesive failure, both of those in Example B-1 and B-2 provide enough mat-feeling and make up for their light diffusion. By the way, in the comparative Examples b-1 to b-3, differently from the Examples, the transfer is done with peeling which will occur at the interfaces between the substrate and protective layer. This provides the transferred surfaces with extremely smooth and greater gloss, due to a extremely smooth surface of the substrates.

As concerning Examples B-3 to B-5, there are laminated the adhesive layer or protective layer in addition to the peeling and white ink layers. In these Examples, it is surely avoided that the light diffusion and light transmission suitably provided by the peeling and white ink layers are deteriorated. Concurrently with this advantage, there can be provided higher adherence of the adhesive layer with the image-receiving sheet and superior durability including higher resistance to plasticizer of the protective layer.

Contrastingly, in Comparative Example b-1, only the white ink layer provides the light diffusion and light transmission. Although the image quality is not poor, the haze is lower than in Example B-1 and the light diffusion is somewhat poor, thus being deteriorated in appearance compared with Example B-1 and others.

In Comparative Example b-2, the white ink layer is not laminated, so that the member is very clear and the haze is low. Thus the background of printed portions and non-printed portions can be seen through it and roughness in brightness of the light source can also be seen.

Furthermore, the feeling for density is poor to make the printed images lacking appeal. As a result, it is found that the electric-decorating members according to Example B-1 to B-5 are more favorable in appearance than this Comparative Example 2.

As seen in Comparative Example b-3, if an attempt is made such that only the white ink layer provides the light diffusion as high as Example B-1, the total light transmittance becomes lower, providing darkened images. Therefore, as regarding electric-decorating display members, Examples B-1 to B-5 are more favorable thanks to their good appearance.

According to the present invention, provided are image-printed materials having a number of advantages: they can meet the demand that persons would like to use electric-decorating display members to which characters and/or images of different pieces of information are recorded, as seen in personal use; they have higher durability including water resistance and scuff resistance to printed images; they have image quality as excellent in continuous gradations as color photographs; and they have good appearance due to a combination of suitable light diffusion and suitable light transmission. There is also provided a thermal transfer sheet used in producing such image-printed material. Still, there is provided a recording method of producing such image-printed material.

Further, in the invention, since a thermal transfer sheet has a layer construction in which a white transfer layer is on a substrate, the white transfer layer including at least a peeling layer and white ink layers which are laminated in this order when viewing from the substrate, the white ink layer containing a white pigment and/or filler, and the peeling layer gives rise to cohesive failure in the thermal transfer process, an image-printed material is obtained to have irregularities on the peeled layer which positions at the top surface. Thus it can be achieved to supply electric-decorating display members which are superior in durability such as scuff resistance and resistance to fingerprints.

Still further, in a thermal transfer sheet having the peeling layer of the invention, it is enough to produce cohesive failure in a peeling layer during thermal transfer process. Thus, adherence between the peeling layer and a substrate as well as between the peeling layer and a white ink layer (or protective layer) can be raised up to higher degrees which provide a favorable layer-sustaining performance for the thermal transfer sheet.

What is claimed is:

1. A thermal transfer sheet comprising a white transfer layer and substrate, the white transfer layer transferable to an image-receiving sheet is provided on at least one region of the substrate, wherein the white transfer layer has a multi-layer construction including at least a peeling layer and a white ink layer, the peeling layer being positioned in contact with the substrate, the white ink layer contains at least one component selected from a group of components consisting of a white pigment and a filler, and the peeling layer, in thermal transfer processing, capable of not only being torn at a center or approximate center in a range of thickness of the peeling layer but also causing a cohesive failure on a torn surface of the peeling layer so that irregularities are formed on the torn surface owing to the cohesive failure.

2. The thermal transfer sheet as claimed in claim 1, wherein the thermal transfer sheet is a monolithic type of thermal transfer sheet in which the white transfer layer and a dye layer are provided sequentially and alternately on a same surface of the substrate.

3. The thermal transfer sheet as claimed in claim 1, wherein the white transfer layer has a multi-layer construction in which the peeling layer, the white ink layer, and an adhesive layer are laminated one on another in order of the peeling layer, the white ink layer, and the adhesive layer viewing from the substrate.

4. The thermal transfer sheet as claimed in claim 1, wherein the white transfer layer has a multi-layer construction in which the peeling layer, a protective layer, and the white ink layer laminated one on another in order of the peeling layer, the protective layer, and the white ink layer viewing from the substrate.

5. The thermal transfer sheet as claimed in claim 1, wherein the white transfer layer has a multi-layer construction in which the peeling layer, a protective layer, the white ink layer, and an adhesive layer are laminated one on another in order of the peeling layer, the protective layer, the white ink layer, and the adhesive layer viewing from the substrate.

6. The thermal transfer sheet as claimed in claim 1, wherein the white transfer layer has a total light transmittance of 30 to 95% and a haze of 30 to 95%.

7. The thermal transfer sheet as claimed in claim 1, wherein the peeling layer contains at least a binder resin having a glass transition temperature, or a softening point of not less than 100° C. and a releasing material having a content of not more than 200 wt % to the binder resin.

8. The thermal transfer sheet as claimed in claim 1, wherein the thermal transfer sheet is used for manufacturing an electric-decorating display member.

9. An image-printed material manufactured by performing thermal transfer processing to an image-receiving sheet, wherein the material comprising at least an image-formed portion formed by migrating a dye from a dye layer of a thermal transfer sheet to a substrate or an image-receiving layer of the image-receiving sheet and a white layer having a multi-layer construction including at least a peeling layer and a white ink layer and being provided on the image-formed portion, wherein the white ink layer contains at least one component selected from a group of components consisting of a white pigment and a filler, and a surface of the peeling layer is provided with irregularities on the surface.

10. The image-printed material as claimed in claim 9, wherein the image-printed material is an electric-decorating display member.

11. A recording method of forming an image-printed material by performing thermal transfer processing to an image-receiving sheet, the method comprising the steps of:

forming an image by migrating a dye from a dye layer of a thermal transfer sheet to a substrate or an image-receiving layer of the image-receiving sheet, and thermal-transferring a white transfer layer from the thermal transfer sheet or further thermal transfer sheet onto a portion of the formed image, the white transfer layer including at least a peeling layer capable of producing a cohesive failure and a white ink layer containing at least one component selected from a group of components consisting of a white-pigment and a filler, thereby the thermal transfer processing enabling the peeling layer to form irregularities on an exposed surface of the transferred peeling layer oweing to the cohesive failure.

12. The recording method as claimed in claim 11, wherein the recording method is used for manufacturing an electric-decorating display member.

* * * * *